US010357426B2

(12) United States Patent
Rabil

(10) Patent No.: US 10,357,426 B2
(45) Date of Patent: Jul. 23, 2019

(54) PERSONAL MASSAGE DEVICE AND STORAGE FOR SAME

(71) Applicant: Tamara Rabil, Delray Beach, FL (US)

(72) Inventor: Tamara Rabil, Delray Beach, FL (US)

( * ) Notice: Subject to any disclaimer, the term of this patent is extended or adjusted under 35 U.S.C. 154(b) by 652 days.

(21) Appl. No.: 14/976,858

(22) Filed: Dec. 21, 2015

(65) Prior Publication Data

US 2016/0175188 A1 Jun. 23, 2016

Related U.S. Application Data

(60) Provisional application No. 62/094,377, filed on Dec. 19, 2014.

(51) Int. Cl.
*A61H 23/02* (2006.01)

(52) U.S. Cl.
CPC ..... *A61H 23/0263* (2013.01); *A61H 2201/01* (2013.01); *A61H 2201/0119* (2013.01); *A61H 2201/0153* (2013.01); *A61H 2201/0161* (2013.01); *A61H 2201/0192* (2013.01); *A61H 2201/0207* (2013.01); *A61H 2201/0221* (2013.01); *A61H 2201/5058* (2013.01)

(58) Field of Classification Search
CPC ... A47B 97/00; H02J 7/0027; A61H 23/0263; A61H 2201/5058; A61H 2201/0221; A61H 2201/0192; A61H 2201/0161; A61H 2201/0153; A61H 2201/0119; A61H 2201/01; A61H 2201/0207
See application file for complete search history.

(56) References Cited

U.S. PATENT DOCUMENTS 4,098,266 A * 7/1978 Muchisky ..... A61H 23/0263 601/108
5,009,222 A * 4/1991 Her ..... A45C 11/22 206/811
5,830,161 A 11/1998 Cosmano
7,351,215 B1 * 4/2008 Roberts ..... A45D 33/24 132/294
2003/0125648 A1 * 7/2003 Leason ..... A61H 15/0085 601/15
2004/0267173 A1 12/2004 Mangano
2006/0287616 A1 * 12/2006 Nan ..... A45D 34/041 601/17
2007/0249195 A1 10/2007 Tomita et al.
(Continued)

OTHER PUBLICATIONS

International Search Report and Written Opinion issued in International Application Serial No. PCT/US2015/067097 dated May 4, 2016.

*Primary Examiner* — Quang D Thanh
(74) *Attorney, Agent, or Firm* — Mark Whittenberger; Holland & Knight LLP

(57) ABSTRACT

A massage device having a body with two end sections attached to a center section. The center section of the body has a motor and a heating unit, and each end section has an eccentric weight that are connected to the motor such that vibrations generated by the motor are transferred to each eccentric weight. The massage device also has a control mechanism configured to adjust the vibration of the massage device, and a microcontroller connected to the control mechanism and the motor to control the operation of the motor. A storage unit for storing a message device is capable of sanitizing, heating, and charging the message device.

8 Claims, 9 Drawing Sheets

(56) References Cited

U.S. PATENT DOCUMENTS

| | | | | |
|---|---|---|---|---|
| 2007/0249196 | A1* | 10/2007 | Collins | A47B 97/00 439/152 |
| 2008/0306417 | A1* | 12/2008 | Imboden | A61H 19/00 601/134 |
| 2009/0065034 | A1 | 3/2009 | Suzuki et al. | |
| 2011/0172573 | A1 | 7/2011 | Wallace | |
| 2013/0096490 | A1* | 4/2013 | Pelkus | A61H 9/0021 604/24 |
| 2013/0281893 | A1* | 10/2013 | Yang | A61H 23/0263 601/15 |
| 2016/0331308 | A1* | 11/2016 | Zhou | A61B 5/4836 |

* cited by examiner

PERSONAL MASSAGE DEVICE AND STORAGE FOR SAME

CLAIM OF PRIORITY

This application claims priority under 35 U.S.C. § 119(e) to U.S. Provisional Patent Application No. 62/093,377 filed on Dec. 19, 2014, which is hereby incorporated by reference in its entirety.

FIELD

The present disclosure relates generally to a personal massage device and storage unit for said massage device, and more particularly to a massage device that is configurable by a user, and a storage unit that discretely and securely stores and sanitizes said massage device.

BACKGROUND

Devices for providing massage to selected parts of a person's body are well-known. A variety of designs for massage devices have been proposed or are currently on the market, but each of these devices contain one or more design flaws that prevent a user from obtaining maximum pleasure from the device. Namely, a vast majority of massage devices utilize small bullet-type motors that provide only minimal levels of vibration and stimulation. While some massage devices offer increased levels of vibration by using larger and more powerful motors, these devices are typically wired devices that require that they be plugged in to operate, thus diminishing the usability and overall user experience of such devices. Furthermore, the majority of known massage devices are either rigid or pliable in nature, but do not allow for a user to bend or configure the shape of the device to better conform to different body shapes and proportions, and to maintain such a shape during use to increase the user's stimulation and enjoyment. And while many massage devices incorporate the ability to increase or decrease the level of stimulation, many lack sufficient variability in stimulation level, and none provide a means by which to increase the level of stimulation to its maximum level in a convenient fashion in order to quickly enhance a user's experience when desired. Finally, many such massage devices do not contain a self-contained method by which to heat the device to further enhance the user's experience and pleasure.

In addition to the shortcomings of known massage devices, a dedicated storage unit for such a massage device that is both discrete and secure is unknown in the art. Such massage devices are often used in the bedroom, and it is often desirable to have immediate access to such a device. However, users typically prefer to keep such massage devices out of plain sight. Furthermore, an easy and effective means for charging and sanitizing such a massage device is also desirable.

Accordingly, there is a need for a massage device that addresses the enumerated shortcomings of known devices, as well as a discrete and secure storage unit for such a massage device that can provide immediate access, recharging capabilities and a way to easily and effectively sanitize the massage device.

SUMMARY

The present disclosure provides a cordless and rechargeable massage device that provides for increased vibration and stimulation, a bendable design that allows a user to configure the shape of the device to conform to the user's body while maintaining such a shape during use, a control mechanism that allows a user to increase or decrease the level of stimulation as well as increase the level of stimulation to its maximum level in a convenient fashion, and an integrated heating unit to enhance a user's experience.

The present disclosure also provides a dedicated storage unit for such a massage device that is both discrete and secure. The storage unit is designed to look like a common jewelry box that can be kept on a nightstand or dresser, and the storage unit is provided with a discreet fingerprint scanner to provide fast and easy access to its contents by authorized users. The storage unit is also equipped with a heating mechanism and ventilation device to sanitize and remove moisture from the massage device and the interior of the storage unit. Finally, the storage unit allows for recharging of the massage device when it is stored therein, as well as activation of the massage device heating mechanism to further increase a user's pleasure when the massage device is removed from the storage unit and used.

BRIEF DESCRIPTION OF THE DRAWINGS

In order to appreciate the manner in which the advantages and objects of embodiments of the invention are obtained, a more particular description of embodiments of the invention will be rendered by reference to specific embodiments thereof which are illustrated in the appended drawings. Understanding that these drawings only depict preferred embodiments of the present invention and are not therefore to be considered limiting in scope, embodiments of the invention will be described and explained with additional specificity and detail through the use of the accompanying drawings in which.

DETAILED DESCRIPTION

Before describing the disclosed embodiments of the technology in detail, it is to be understood that the technology is not limited in its application to the details of the particular arrangement shown herein since the technology is capable of other embodiments. Also, the terminology used herein is for the purpose of description and not of limitation.

Figure 1:
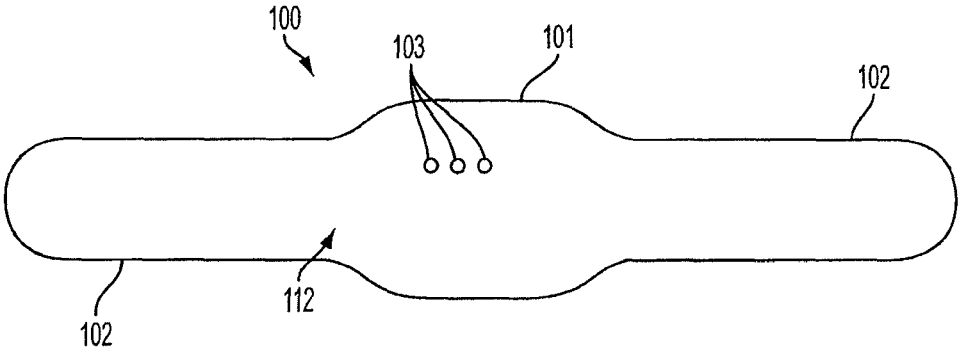
FIG. 1 is a front elevation view of an embodiment of the present invention massage device.
Figure 3:
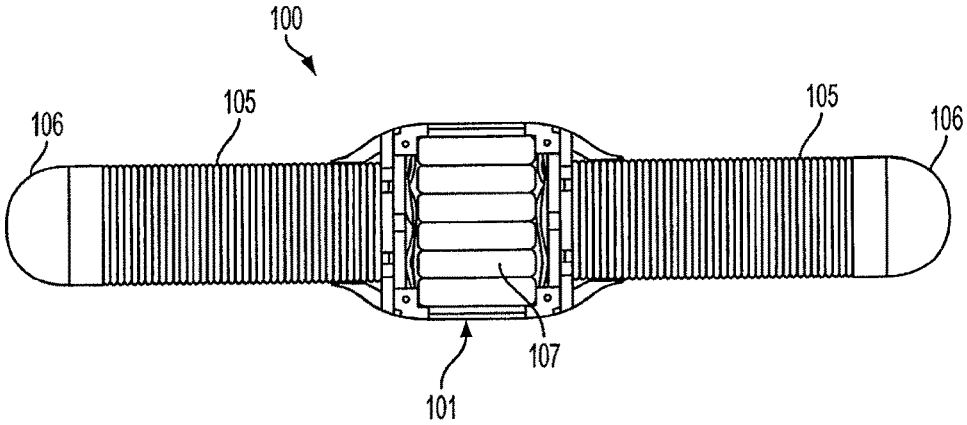
FIG. 3 is a cutaway view of an embodiment of the present invention massage device showing its inner components.
Figure 4:
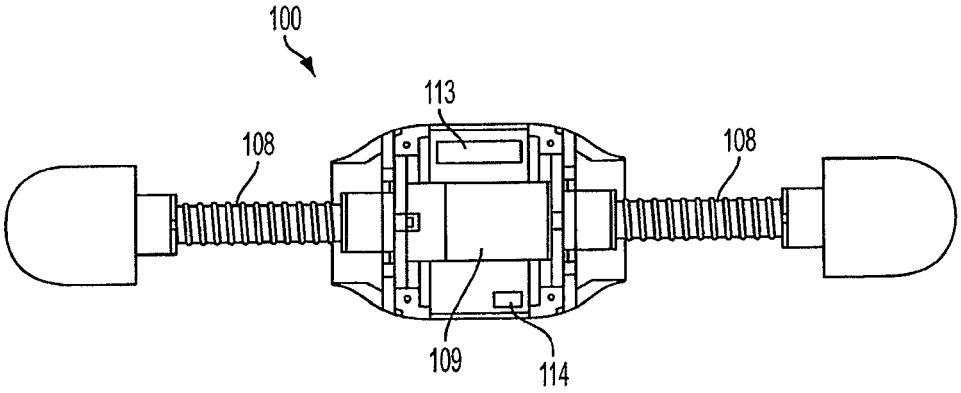
FIG. 4 is a cutaway view of an embodiment of the present invention massage device showing further of its inner components.
Figure 5:
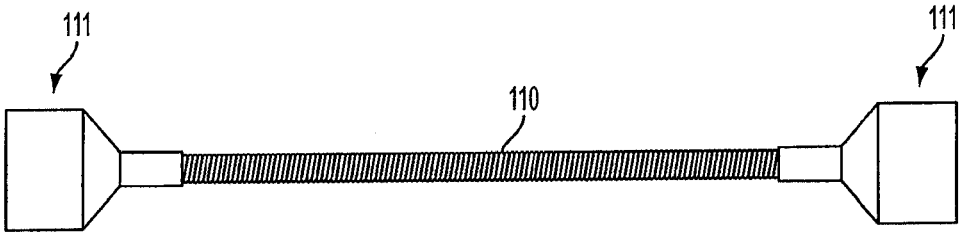
FIG. 5 is an isolated view of a flexible shaft of an embodiment of the present invention massage device.

FIG. 1 is a perspective view of an embodiment of the present invention massage device 100. Massage device 100 has a center section 101 and two end sections 102 attached to center section 101, creating an integral unit. As shown in FIGS. 3 and 4, massage device 100 contains a dual-shaft motor 109 housed within center section 101 connected to and powered by a rechargeable energy storage unit 107 that surrounds motor 109. In the present embodiment, each motor shaft is connected to flexible shaft 110 (shown in FIG. 5) that is at least partially housed within flexible tube 108 (FIG. 4). As shown in FIG. 5, each motor shaft is attached to flexible shaft 110 via one shaft end 111. An eccentric weight (not shown) is attached to the opposite shaft end 111 that is not attached to motor 109. Eccentric weights are housed within eccentric weight housings 106 (FIG. 3) on each end of massage device 100.

When motor 109 (FIG. 4) is activated, vibrations generated by motor 109 are transferred to the eccentric weights via flexible shafts 110 (FIG. 5). The eccentric weights provide for an emphasized vibration sensation at their respective locations within massage device 100. By centrally locating motor 109 away from the extremities of massage device 100, a larger and more powerful motor can be used, while still maintaining a size and geometry of massage device 100 that is suitable and comfortable for users. In addition, use of eccentric weights attached to motor 109 via flexible shafts 110 increases the vibration sensation of massage device 100 at its ends, which increases a user's stimulation and overall experience.

Extension springs 105 (FIG. 3) are fitted around each flexible tube 108 (FIG. 4) to provide the external shape of massage device 100. Extension springs 105 are also flexible, and allow a user to bend end sections 102 into a variety of configurations. Flexible tube 108 is made of a flexible material that also maintains the shape of end sections 102 (FIGS. 1 and 2) once placed in a certain configuration. In the preferred embodiment, flexible tube 108 is made of flexible metal tubing, but other suitable flexible materials that maintain their shape could be employed, as would be understood by someone of ordinary skill in the art.

As shown in FIG. 1, control mechanism 103 is located on the exterior of center section 101. Control mechanism 103 is used to power on, power off and adjust the settings of massage device 100. In the present embodiment, control mechanism 103 is made up of a plurality of buttons. In this embodiment, activation of a first button increases the level of vibration, activation of a second button decreases the level of vibration, and activation of a third button increases the level of vibration to its maximum level. In an alternate embodiment, the third button must be continually depressed by the user in order to maintain the maximum level of vibration. The present embodiment allows a user to quickly and easily change the level of vibration intensity among seven levels, and to increase the level of vibration intensity to its maximum level with the touch of a button to maximize stimulation for the user.

Heating mechanism 113 (FIG. 4) is housed within center section 101. When activated, heating mechanism 113 heats massage device 100 above room temperature for enhanced pleasure of the user during use. Also housed in center section 101 is microcontroller 114 (FIG. 4). Microcontroller 114 is connected to control mechanism 103 and motor 109 (FIG. 4) and serves to control the operation of motor 109 in response to user input. For example, in the present embodiment, when the first button is pressed, microcontroller 114 increases the level of vibration generated by motor 109.

Figure 2:
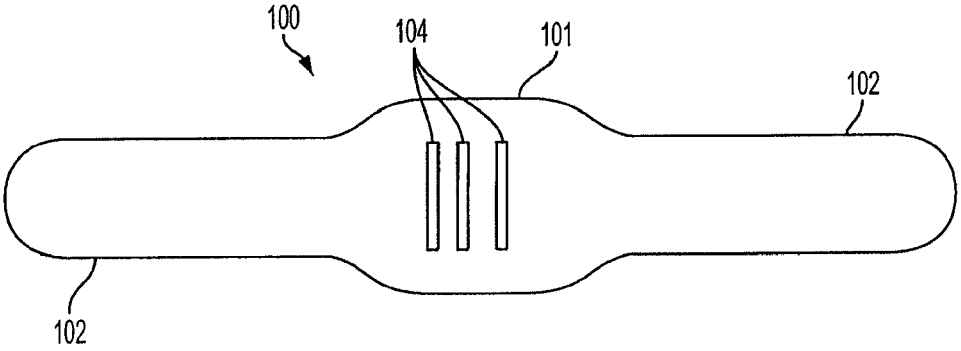
FIG. 2. is a rear elevation view of an embodiment of the present invention massage device.

As shown in FIG. 2, massage device 100 contains contacts 104 made of a conductive material that are electrically connected to energy storage unit 107 (FIG. 3) and heating mechanism 113 (FIG. 4). In the present embodiment, three contacts 104 are located on the exterior of center section 101 opposite from control mechanism 103. When massage device 100 is placed upon a charging device, contacts 104 are used to conduct electrical energy to charge energy storage unit 107 and to activate heating mechanism 113.

As shown in FIG. 1, massage device 100 is covered with an exterior skin 112. In the present embodiment, exterior skin 112 is made of silicone rubber, but other waterproof materials could be used.

In an alternate embodiment, massage device 100 has a first end section and a second end section of different geometries attached to center section 101. In a further embodiment, different levels of vibration can be provided to the first end section and the second end section. This is accomplished by incorporating a second motor into massage device 100, or by introducing a gearing mechanism between motor 109 and flexible shafts 110.

Figure 6:
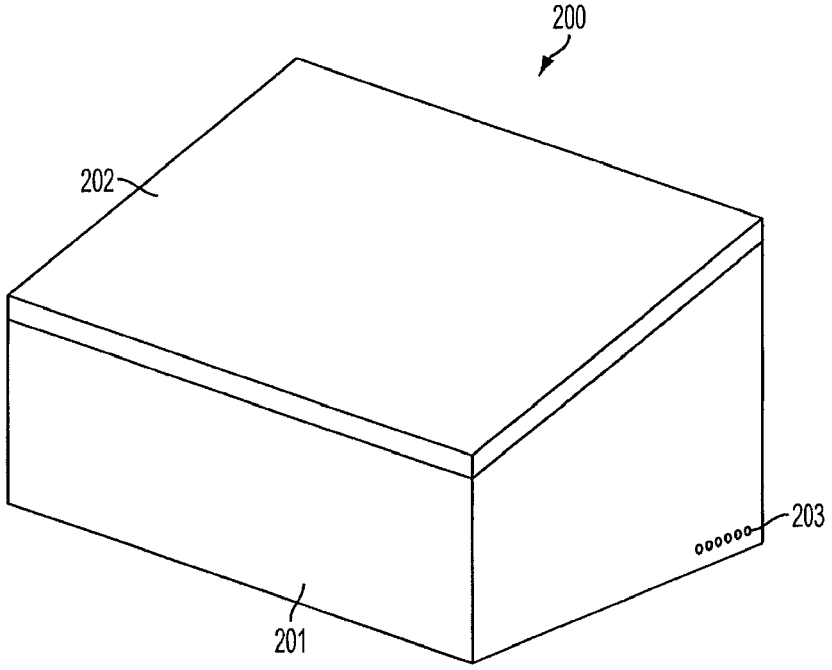
FIG. 6 is a front perspective view of an embodiment of the present invention storage unit for the massage device.
Figure 7:
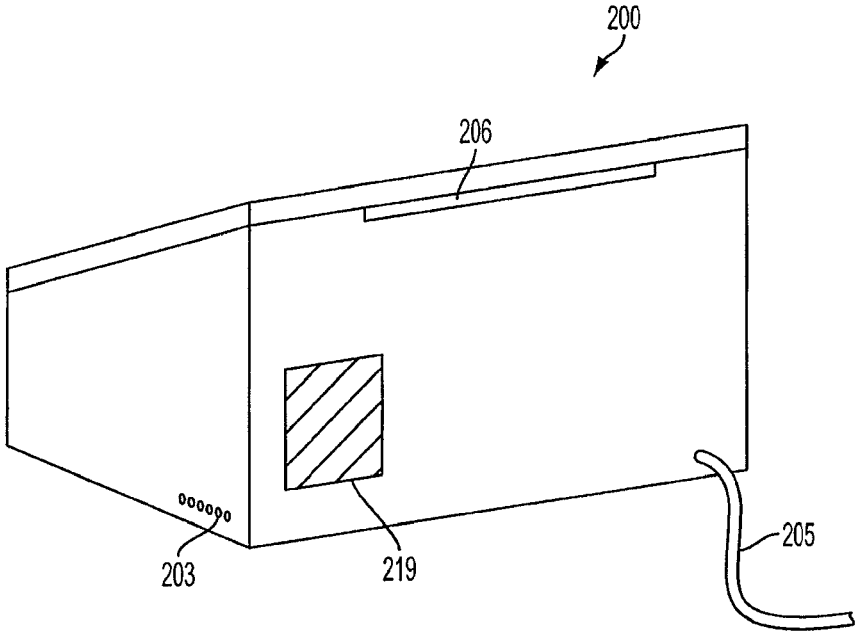
FIG. 7 is a rear perspective view of an embodiment of the present invention storage unit for the massage device.
Figure 8:
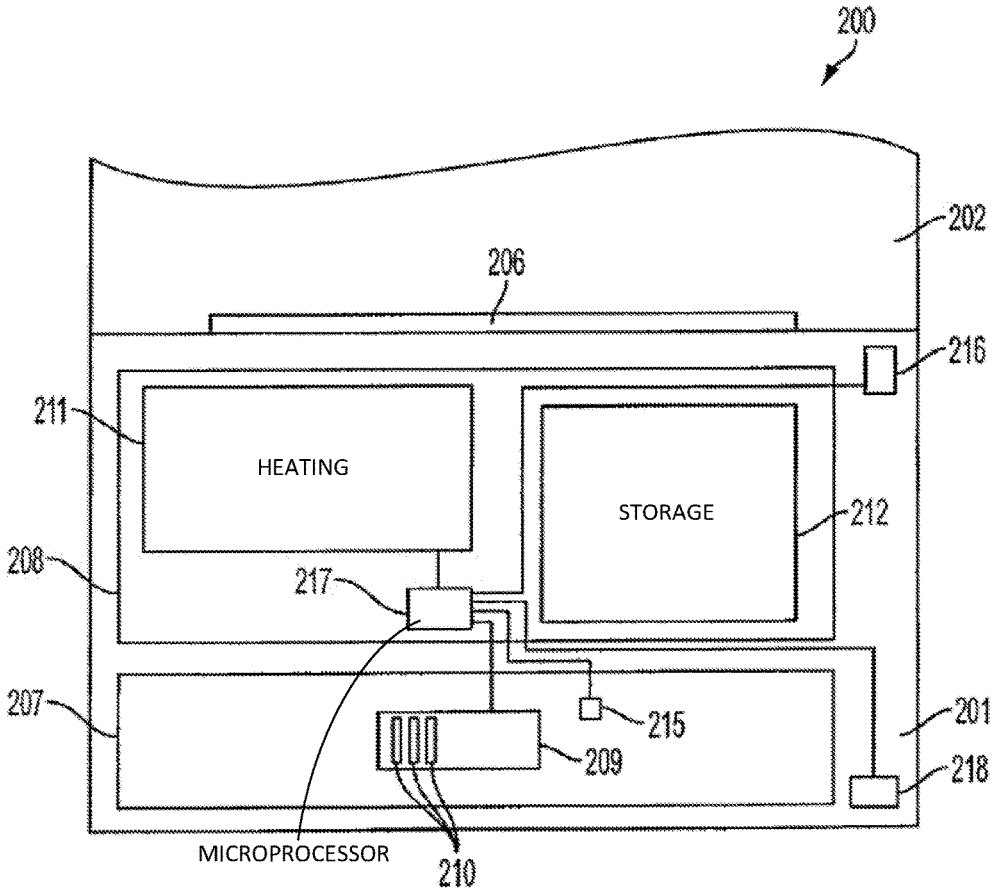
FIG. 8 is a top plan view of an embodiment of the present invention storage unit for the massage device in an opened state.
Figure 9:
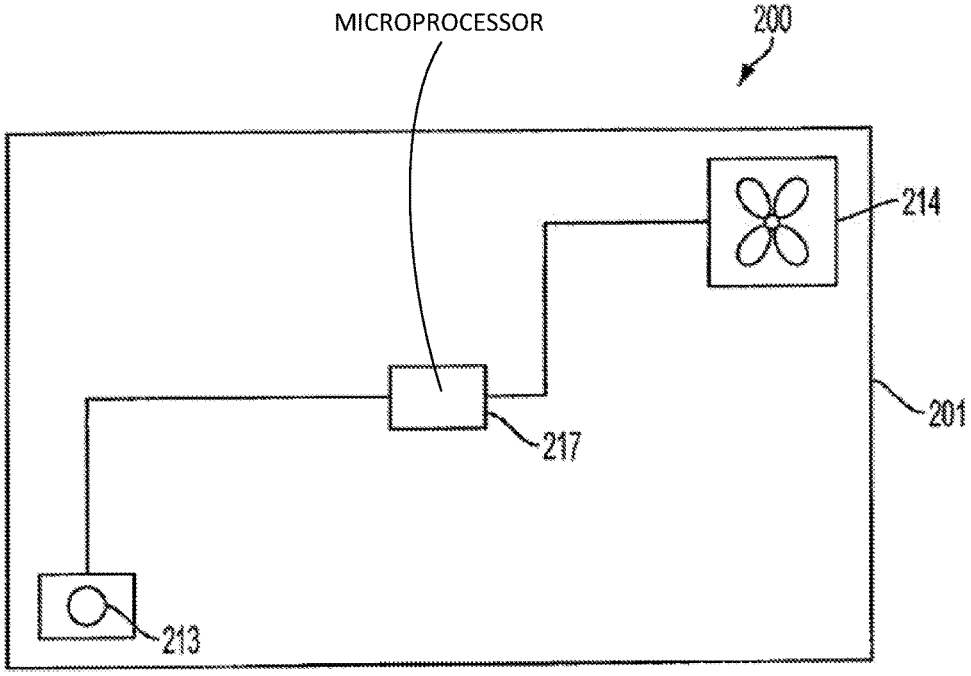
FIG. 9 is a bottom plan view of an embodiment of the present invention storage unit for the massage device.

FIG. 6-9, described below, show various views of a massage device storage unit 200 according to embodiments of the invention. FIG. 6 is a front perspective view of an embodiment of the present invention massage device storage unit 200. FIG. 7 is a rear perspective view of an embodiment of the present invention massage device storage unit 200. FIG. 8 is a top plan view of an embodiment of the present invention massage device storage unit 200 in an opened state. FIG. 9 is a bottom plan view of massage device storage unit 200.

As shown in FIGS. 7 and 8, storage unit 200 comprises base 201 to which lid 202 is rotatably mounted by hinge 206. Base 201 contains lower section 207 and upper section 208. Lower section 207 is designed to hold a personal massage device, such as embodiments of massage device 100 depicted in FIGS. 1-5.

Housed within lower section 207 is a contact bank 209 containing a plurality of contacts 210 made of a conductive material. In the present embodiment, three contacts are employed that are arranged to align with contacts 104 of personal massage device 100 such that when massage device 100 is placed in lower section 207 and contacts 104 and contacts 210 align and touch, electrical energy is conducted to massage device 100 to charge energy storage unit 107 and to activate heating mechanism 113.

Housed within upper section 208 is a storage area 212 used for storing accessories typically used with a massage device, such as lotions or lubricants. Also housed with upper section 208 is a storage unit heating mechanism 211.

First sensor 215 and second sensor 216 are located within base 201. First sensor 215 detects whether a massage device is present within lower section 207, and second sensor 216 detects whether lid 202 is in the closed position. In the present embodiment, sensors 215 and 216 are microswitches, but it is understood that any suitable sensor could be employed, as would be understood by someone of ordinary skill in the art. Locking mechanism 218 is also located within base 201 and engages lid 202 when lid 202 is in a closed position to prevent the opening of lid 202. Electrical energy is provided to power storage unit 200 via power cord 205.

Ventilation fan 214 is located in the bottom of base 201, allowing air to pass between the interior and exterior of storage unit 200. Fingerprint scanner 213 is also located on the bottom of base 201. Indicator 203 and vent 219 are located on the exterior sides of base 201. Indicator 203 provides indication of the status of a number of storage unit components. In the present embodiment, indicator 203 consists of a plurality of LED's. Indicator 203 indicates whether electrical power is being supplied to storage unit 200, whether storage unit heating mechanism 211 and ventilation fan 214 are activated, and the status of sensors 215 and 216.

Microcontroller 217 is housed within storage unit 200 and is connected to one or more of indicator 203, contact bank 209, storage unit heating mechanism 211, fingerprint scanner 213, ventilation fan 214, first sensor 215, second sensor 216, and locking mechanism 218. Microcontroller 217 monitors the status of sensors 215 and 216. When microcontroller 217 detects that a massage device is present in lower section 207 and lid 202 is in the closed position, microcontroller 217 activates storage unit heating mechanism 211 and ventilation fan 214. Heating mechanism 215 raises the temperature within storage unit 200 to a temperature sufficient to sanitize massage device 100 and the interior of storage unit 200. When activated, ventilation fan 214 draws air into storage unit 200 though vent 219. Air travels throughout storage unit 200 and over the massage device (e.g., massage device 100) before exiting storage unit 200 though ventilation fan 214 located in the bottom of storage unit 200. The introduction of exterior air into storage unit 200 and removal of air within storage unit 200 assists in the removal of moisture from massage device 100 and from the interior of storage unit 200.

Microcontroller 217 also detects whether a user who has access rights to storage unit 200 places his or her finger on fingerprint scanner 213, thereby causing locking mechanism 218 to disengage lid 202 allowing access to storage unit 200. The use of fingerprint scanner 213 prevents unauthorized access to storage unit 200, as well as immediate access to storage unit 200 without the need for a key, code, or other alternate method to unlock storage unit 200.

The shape and design of storage unit 200 also serve a number of purposes. Storage unit 200 may look similar to a typical jewelry box, or the like, and can be located out in the open, allowing for discreet storage of a massage device as well as easy accessibility. As shown in FIGS. 6 and 7, the base 201 can have a lower vertical dimension in the front of storage unit 200 than in the rear. This design reduces the volume of storage unit 200 when compared to a rectangular design, which allows for a reduction in the power consumption and size of heating mechanism 211, as well as a reduction in the time required to heat the interior of storage unit 200 to an adequate temperature to sanitize massage device 100. Furthermore, in one embodiment, the shape of present invention storage unit 200 prevents dead air space from developing in the interior of storage unit 200, allowing for increased circulation and moisture removal.

I claim:

1. A massage device storage unit comprising:

a base comprising an upper section and a lower section, the lower section configured to hold a massage device;

a lid mounted to the base; and a first sensor and a second sensor, wherein the first sensor detects whether the massage device is present within the lower section, and wherein the second sensor detects whether the lid is in a closed position.

2. The massage device storage unit of claim 1, further comprising a contact bank configured to charge the massage device.

3. The massage device storage unit of claim 1, further comprising a contact bank configured to activate a heating mechanism of the message device.

4. The massage device storage unit of claim 1, wherein the upper section comprises a heating mechanism.

5. The massage device storage unit of claim 1, further comprising a ventilation system.

6. The massage device storage unit of claim 1, further comprising a fingerprint scanner, wherein the fingerprint scanner is configured to allow access to the massage device storage unit.

7. The massage device storage unit of claim 1, further comprising a microcontroller, wherein the microcontroller upon detecting the presence of the massage device and the lid is closed, activates a heating mechanism and a ventilation system.

8. The massage device storage unit of claim 7, wherein the heating mechanism is configured to raise the temperature within the storage unit.

* * * * *